US005951113A

United States Patent [19]

Lewis, Jr.

[11] Patent Number: 5,951,113

[45] Date of Patent: Sep. 14, 1999

[54] INTEGRALLY FUSED CIRCULAR BRUSH CONSTRUCTION

[75] Inventor: John C. Lewis, Jr., Salisbury, Vt.

[73] Assignee: Tucel Industries, Inc., Forestdale, Vt.

[21] Appl. No.: 09/014,707

[22] Filed: Jan. 28, 1998

[51] Int. Cl.[6] ..... A46B 3/06

[52] U.S. Cl. ..... 300/21; 15/159.1; 15/164; 15/171; 15/176.2; 15/193

[58] Field of Search ..... 15/159.1, 164, 15/165, 171, 176.2, 187, 192, 193; 300/1, 21

[56] References Cited

U.S. PATENT DOCUMENTS

| | | | |
|---|---|---|---|
| 91,314 | 6/1869 | Dudley | 15/176.2 |
| 1,924,147 | 8/1933 | Bates | 15/176.2 X |
| 3,604,043 | 9/1971 | Lewis, Jr. | 15/159.1 |
| 4,189,189 | 2/1980 | Lewis, Jr. | 300/7 |
| 4,291,431 | 9/1981 | Lewis, Jr. | 15/159.1 |
| 4,348,060 | 9/1982 | Lewis, Jr. | 300/21 |
| 4,690,277 | 9/1987 | Lewis, Jr. | 206/362.1 |
| 4,693,519 | 9/1987 | Lewis, Jr. | 300/7 |
| 5,511,274 | 4/1996 | Lewis, Jr. | 15/160 |
| 5,597,212 | 1/1997 | Lewis, Jr. | 300/21 |
| 5,678,899 | 10/1997 | Lewis, Jr. | 300/21 |

FOREIGN PATENT DOCUMENTS

| | | | |
|---|---|---|---|
| 322599 | 7/1920 | Germany | 15/171 |

*Primary Examiner*—Mark Spisich
*Attorney, Agent, or Firm*—Donald C. Casey

[57] ABSTRACT

A hollow brushware article and its method of construction are described. The brushware article is constructed from a thin thermoplastic base having arms radiating from a center portion and tufts integrally fused on the upper surface of the base. The terminal portions of the arms mount segmented threads at ends thereof on the upper surface, and the lower surface mounts an aligning member so that when the ends are drawn together with the aligning member abutting, a hollow brushware article will be formed with a threaded male portion for receipt in a female handle member.

10 Claims, 6 Drawing Sheets

INTEGRALLY FUSED CIRCULAR BRUSH CONSTRUCTION

BACKGROUND OF THE INVENTION

CROSS-REFERENCE TO RELATED APPLICATIONS

This application is related to my application Ser. No. 08/816,034 filed Mar. 11, 1997, U.S. Pat. No. 5,813,729 and related to my patent application Ser. No. 08/540,504 filed Oct. 10, 1995, U.S. Pat. No. 5,678,899.

FIELD OF THE INVENTION

This invention relates to the manufacture of fused brushware products which may be manufactured from a single raw material so that the products are recyclable and in particular to a two dimensional product to which tufts are fused and which is configured to be assembled into a three dimensional brush having a circular cross-section and a threaded base for receiving a separate handle.

DESCRIPTION OF THE PRIOR ART

Many different types of brushware products have been devised over the past several years which include wire set, anchor set, staple set, twisted-in-wire and resin set designs wherein both natural and synthetic filament materials are formed in tufts and mounted in a base or brush block. In many of my prior U.S. Patents various methods are described for fusing tufts and forming tufted fused brushes and mat-like devices wherein synthetic filament tufts are fused to molded base sections. For example, U.S. Pat. Nos. 3,604,043; 4,189,189; 4,291,431; 4,348,060; 4,690,277; 4,693,519; 5,511,274; 5,597,212; and 5,678,899 describe such constructions. These patents are all assigned to the Assignee of this patent application, Tucel Industries, Inc. and the disclosures thereof are hereby incorporated by reference.

In U.S. Pat. No. 5,511,274 there is described a tufted construction formed of a thermoplastic sheet which defines a two dimensional projection of a three dimensional tufted construction. Mutually spaced pre-fused tufts are mounted at specific pre-selected areas on one surface and the three dimensional design then includes a radial surface having tufts thereon and a handle portion integral therewith. After tufts are fused to the surface, the two dimensional object is assembled into a three dimensional tufted construction by joining edges to form the three dimensional arcuate construction about a handle portion. Typically, as is the case with the instant invention, a very thin sheet is used and thickened tufts receiving sites are provided on the surface to which the fused tufts are to be attached. In this way a minimum of material is required in order to form a brush construction useful, for example, as a kitchen scrub brush or small broom.

In this case the two dimensional base is assembled as a three dimensional tufted construction by insertion of pre-molded tabs in slots to retain radial surfaces in a curved configuration. This type of construction, however, is not as durable as might be desired in that the tab in slot formation may separate during vigorous usage.

SUMMARY OF THE INVENTION

It has been discovered that a superior tufted construction can be provided using fused tufted filaments on a mat-like base wherein the fused tufts are integrally formed to extend from sections of the base which then can be brought together to form a handle portion with tufts radiating outwardly therefrom. The improved device of this invention generally then includes an integrally molded and placement area, handle or attachment means, in order to use the brushware effectively, and a predetermined tuft construction which can be formed using the tufting procedures for fused tufts together with ordinary brush making technology to form a product which uses less raw material and energy during manufacture. The device of this invention then forms a tufted construction having a brush portion which has integrally fused tufts extending outwardly therefrom and a circular cross-sectional configuration extending upwardly from a handle mounting portion wherein the mat-like construction portions are drawn together to form the handle portion which is then secured to a female end of a handle member so that the brush construction will withstand vigorous scrubbing action.

Accordingly it is an object of this invention to provide a three dimensional tufted construction formed from a two dimensional mat with integrally fused tufts extending from a portion thereof with an integral handle portion.

It is another object of this invention to provide a three dimensional tufted construction having integrally fused tufts extending outwardly from a hollow brush base portion, which has a circular cross-sectional configuration and a handle portion wherein the extremities of the mat are drawn together in positive engagement.

It is still another object of this invention to provide a hollow brush construction wherein fused tufts of filamentary material extend outwardly from a relatively thin base member and wherein the base member is initially a two dimensional star-shaped mat having a center and radial, spaced arms extending outwardly therefrom, the end portions of which when drawn together form a male member for insertion in a handle.

It is still another object of this invention to provide a three dimensional hollow plastic tufted construction wherein tufts of filamentary material are integrally fused to the outer surface thereof and which brush member is formed from two dimensional stock wherein the stock is tufted and then folded against itself to form the brush construction.

DEFINITIONS

The term "brushware" as used hereinafter includes any device, either a brush or broom, having both synthetic filament and a molded base means including a hand placement area and/or handle means.

The term "synthetic" filament as used hereinafter includes filaments which are formed from linear thermoplastic polymers from the group consisting of polystyrene and polystyrene co-polymers, polyvinyl chloride and polyvinylchloride-acetate co-polymers, polyethylene, polypropylene, polyethylene-polypropylene co-polymers, polyamides, polyesters and polyurethane. Both oriented and unoriented filament may be employed. Also, various filament cross-sections may be imparted, such as for instance, circular, lobular, trifoil, X, and Y cross-sections, triangular, polygonal, star, etc. Mixtures of synthetic filament may be employed in cases where the compositions of the filament are compatible during any fusing operations, for example, heat-sealing. Such filaments may have suitable crimp imparted to their length or a portion thereof. Filaments may contain organic or inorganic modifications in order to make them biodegradable, or self-decompose during or after use for a given period of time.

The term "picking" as used in the specification refers to the formation of filament tufts wherein two or more tufts are formed simultaneously by longitudinally engaging more than one cut-to-length filament at its end and removing said filament from a parallel disposed bundle of filaments. The picking devices employed are those types which are disclosed in U.S. Pat. Nos. 3,471,202; 3,910,637; 4,009,910 and 4,109,965 all issued to the inventor of this application.

The term "configured" refers to any design that will become a three dimensional shape after a flat, two dimensional molded thermoplastic sheet has been fused and assembled into a brushware construction.

The term "recyclable" refers to any brushware made according to the instant invention and comprised wholly of thermoplastic filament and molded base having the same chemical raw material, so that when the brushware is ground up, it can be reused to produce a like item, or be used as post-consumer resin to be used for something other than brushware.

DETAILED DESCRIPTION OF THE PREFERRED EMBODIMENTS OF THE INVENTION

Figure 1:
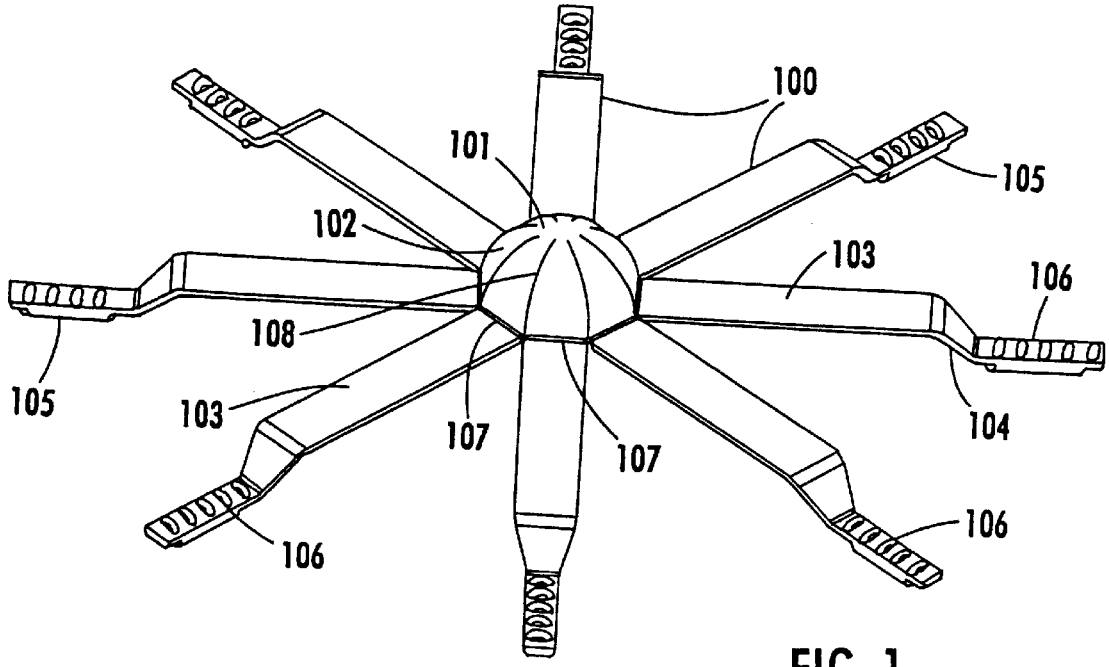
FIG. 1 is a top perspective view of the unassembled two dimensional handle and filament support member before tufts are mounted thereon.

A brushware device of the instant invention is constructed by first molding a thin, single plane support 100 preferably from polypropylene homopolymer, as shown in perspective view FIG. 1, comprising both synthetic filament support 102 and 103, and handle support extension 106 defined collectively as an "arm" radiating outward from a central and integrally connected center point 101. The simplicity of the molded part allows for a flat parting-line mold construction, and a fast molding cycle, for example, 12 seconds. Each of the filament support means 102 and 103 are connected by molded "hinge" section 107. The arm further extends by thread means 106 as integrally connected to support 103 by extension 104. An edge aligning member 105 is located on the opposite side of threaded member 106. A separating edge 108 runs along each side of the tuft supporting member 102, to allow flattening the support 102 during fusing of tufts thereon.

Figure 2:
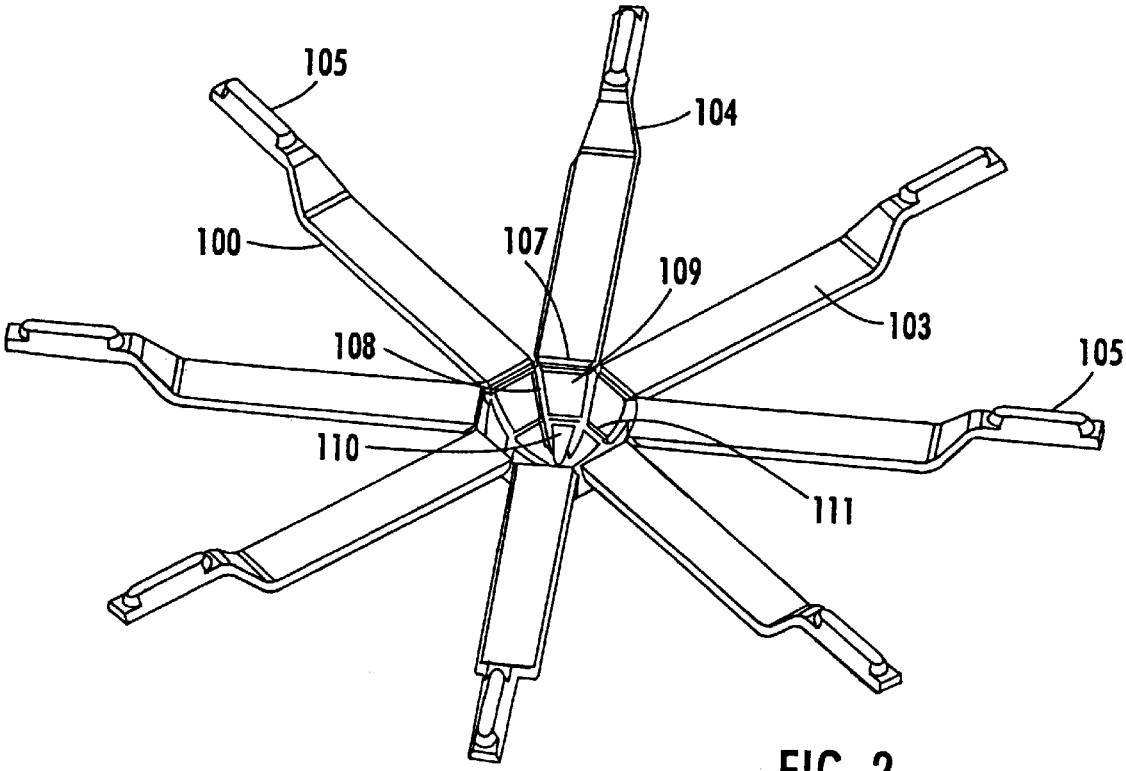
FIG. 2 is a bottom perspective view of the member of FIG. 1.

The perspective view of FIG. 2 illustrates the "hinge" constructions at points 107 and 111, thus allowing for flexible sections at 103, 109 and 110 to become separate and distinct filament accepting planes during the fusing process. A preferred enlarged area at 105 for extra support for the threaded means located at 106 on the reverse side of 105 also allows for greater surface contact between the extended threaded portions 105/106. When the extended ends are folded and come together to form the three dimensional threaded means for the finished brush product, the threaded ends may be received in a female accepting pre-threaded handle. Each extended threaded means 106 has only a portion of the predetermined thread size located along it length, so as to allow a standard thread configuration to be formed when the "arms" are brought together, creating what appears to be a solid, threaded projection extending from the filament accepting portions 103. See FIGS. 6 and 7.

Figure 3:
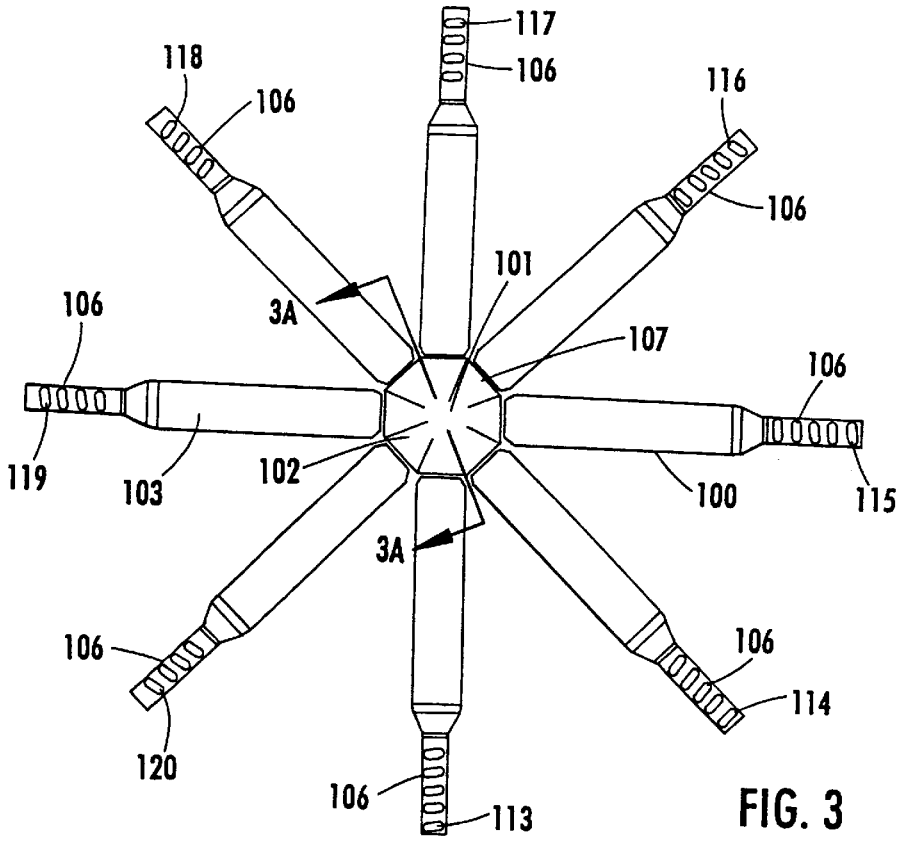
FIG. 3 is a top view of the member of FIG. 1.

The flat top view of FIG. 3 illustrates the thread construction at each of the eight (8) radiating arms 106 where there are five projecting and raised portions of angled thread means 113, 114, 115, 116 and four raised portions of angled thread mean 117, 118, 119, and 120. These raised and angled thread portions are set onto the extension 106 in such a manner that when the extensions are aligned, a given thread diameter and size is automatically formed, for example, 11/16 inch diameter-6 thread/inch.

Figure 4:
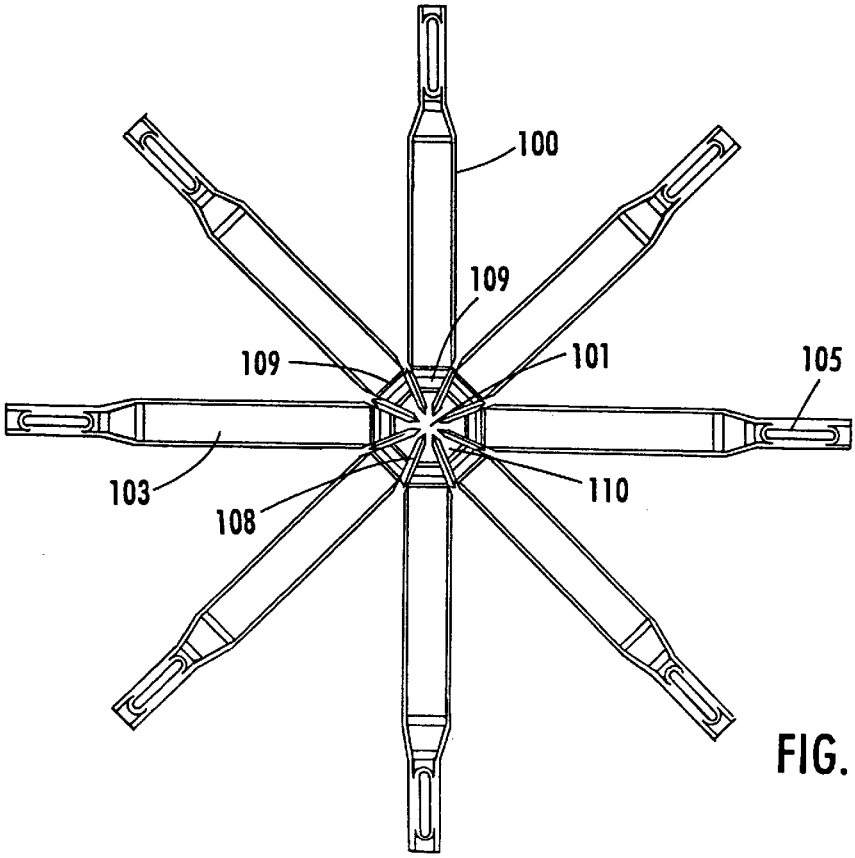
FIG. 4 is a bottom view of the member of FIG. 1.

FIG. 4 defines the actual areas for accepting filament tufts. The areas are defined as the extended segments 102 and 103 from FIG. 3, but as shown in FIG. 4, the segments 102 are actually separated into separate areas 109 and 110 along the open space 108. These two areas 109 and 110 are located between "hinges" 107 and 111 and integral with center portion 101 wherefrom the original extensions protrude. This design allows the extended portion 102 to be flexed at the "hinge" thus allowing the curved 102 to lay flat during the fusing process.

Figure 3A:
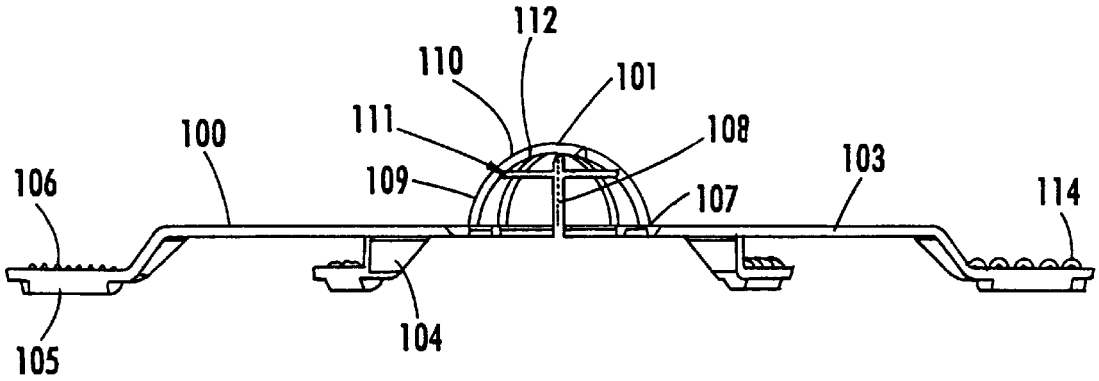
FIG. 3*a* is a cross-sectional view taken along line 3A—3A of FIG. 3.

FIG. 3*a* is a cross-section of FIG. 3 taken along line 3A—3A showing the open space 108 between each extension 102 as well as the two areas for receiving fused filament tufts 109 and 111. The extensions are integral but start to extend at point 112 from the main body of the molded block 101.

This design allows for positioning the extended filament accepting portions consisting of the entire radiating "arms" in any attitude during the fusing step in order to place filament tufts at any desired angle.

Figure 5:
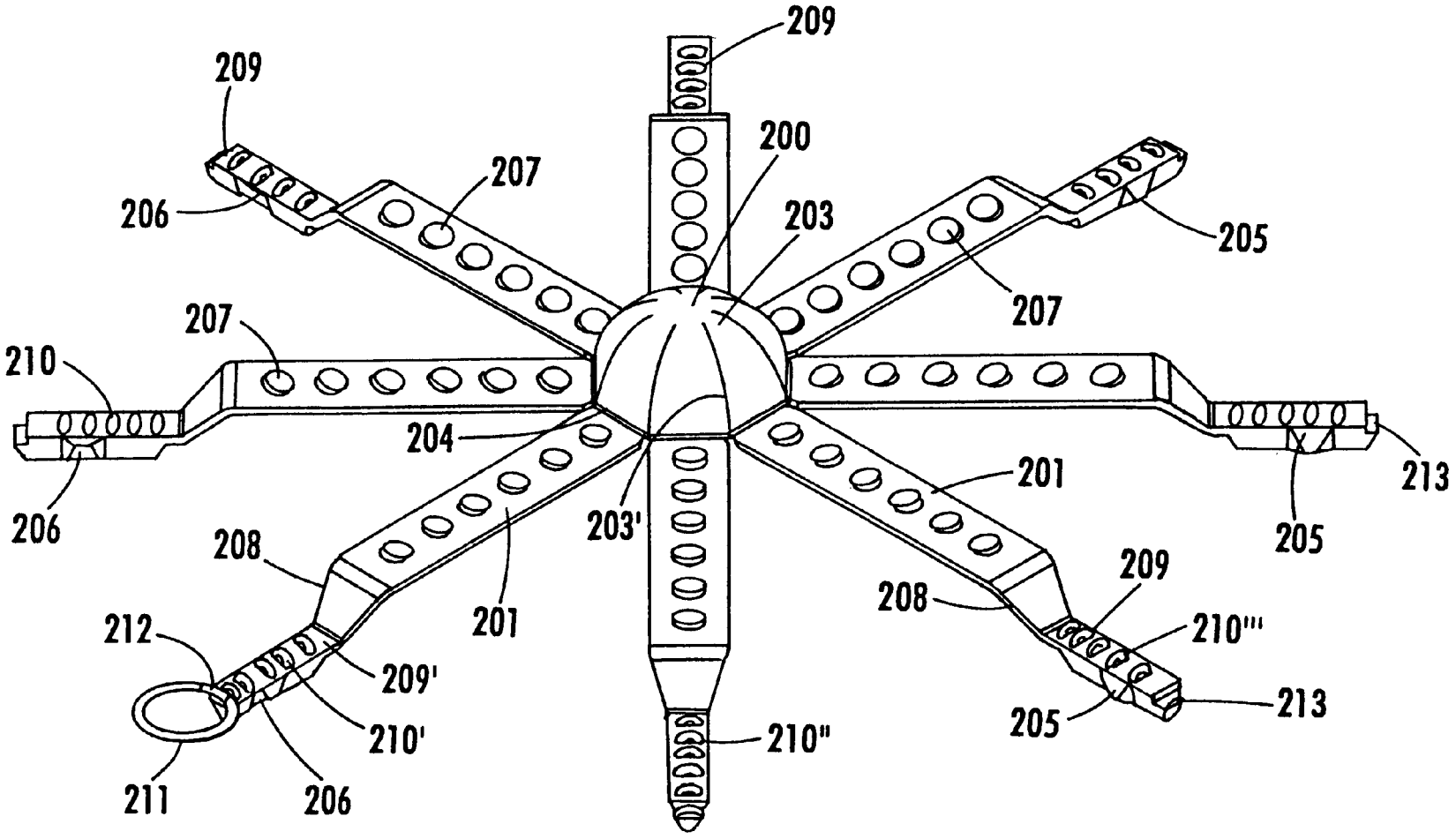
FIG. 5 is a top perspective view of the member of FIG. 1 showing the tuft receiving sites on the upper surface prior to fusing tufts thereon.

A preferred embodiment of the instant invention is illustrated in FIG. 5 whereby an eight "arm" molded integral construction 200 has extensions comprised of individual interconnected segments 203, 201, 208 and 209 radiating from the central construction 200. The resultant construction 200 will become a glass washing brush which will fit inside of a 3 inch deep tumbler. The segment 203 has open sided 203' on each side of it and starts radiating from construction 200 and ends with a "hinge" 204 design integral with the continued extension 201 having raised portions 207 along its length defining means for the future fused filament tufts to be fused thereon; the end of the extension 201 terminates with an integrally connected angled extension 208 which in turn is integrally connected thereto the extension 209. This portion of the extension terminates and forms the end of each extension.

The extension portion 209 contains both a male, 205, and female, 206, type protrusion and indent means respectively, in order that the sides can align themselves during the folding process after the required filament tufts are fused thereon. Additionally, one of the extended portions, 209', contains an integrally molded and extended circular ring, 211 "hinged" at 212, which ultimately serves as a locking means to become folded over the molded notch 213 at the end of each extension 209.

Figure 6:
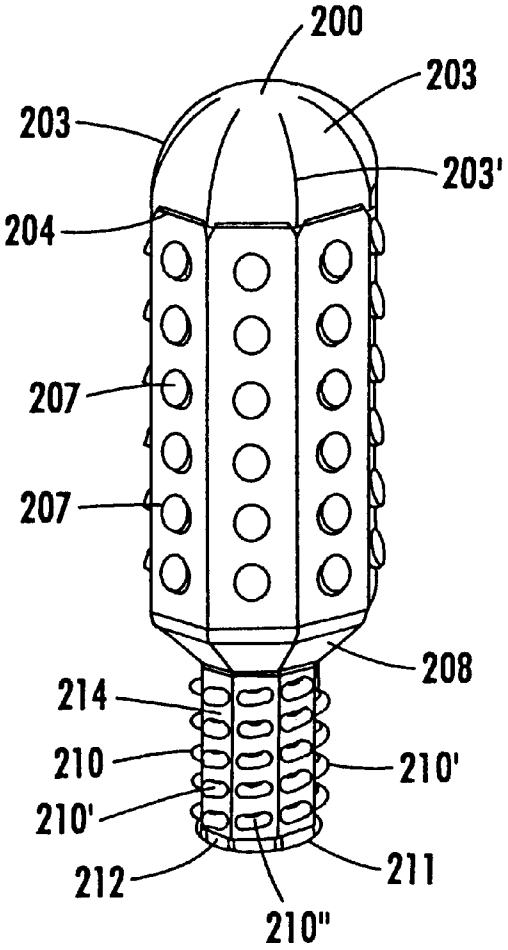
FIG. 6 is a assembled perspective side view of the folded embodiment of FIG. 5 without tufts fused thereon.

There are also, threaded angular means 210, 210', 210", 210'", etc. located on each of the extended portions 209; some of the threaded means have more pre-thread portions than others, so that when the extensions are folded together and portions 205 and 206 are brought together, a continuous full finished thread 214, as illustrated in FIG. 6, is obtained from the sum of the individual proportionate thread portions located on each of the said extension 209.

Figure 7:
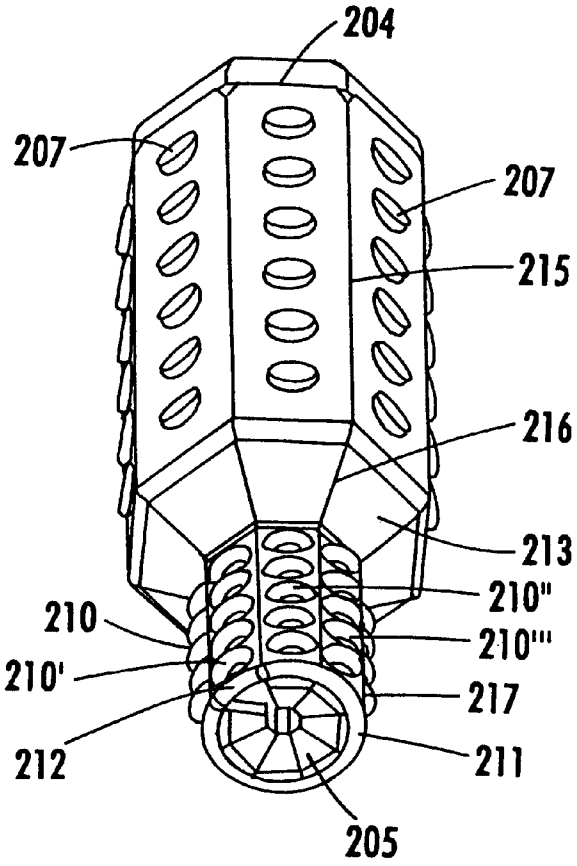
FIG. 7 is an assembled perspective end view of the embodiment of FIGS. 5 and 6.

FIGS. 6 and 7 show the folded construction 200 without any fused filament tufts. The raised filament accepting means 207 are angled in such a manner so as to allow for angled tufts to radiate therefrom. Other angles and configurations are possible whereby every other extended "arm" portion would have an opposing angles set of filament tufts, in order to create a brush cleaning surface which would make part of the filament's surface aggressive on entering the glass to be washed. As the brush is withdrawn, the other filaments would then become the aggressive scrubbers, thus making the brush a dual surface cleaning device.

FIG. 7 illustrates segments 203, 201, 208 and 209 assembled, with sides aligned at points 203', 215, 216 and 217, thus forming a hollow but substantial member, even though the entire structure is made from an extreme support.

Figure 8:
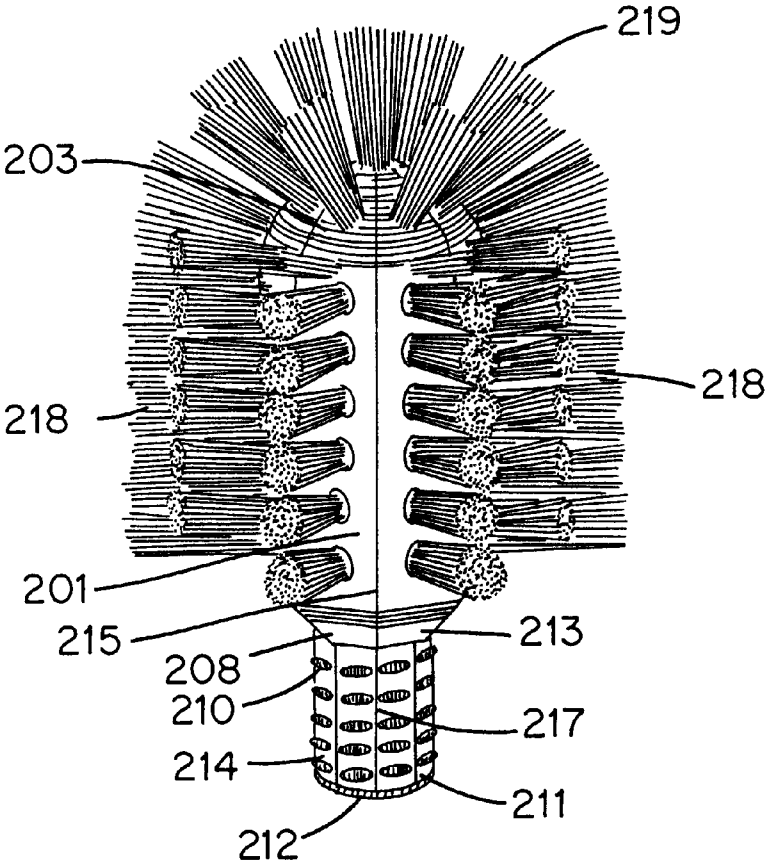
FIG. 8 is an assembled perspective side view of a brush construction using the support member of FIG. 5.
Figure 9:
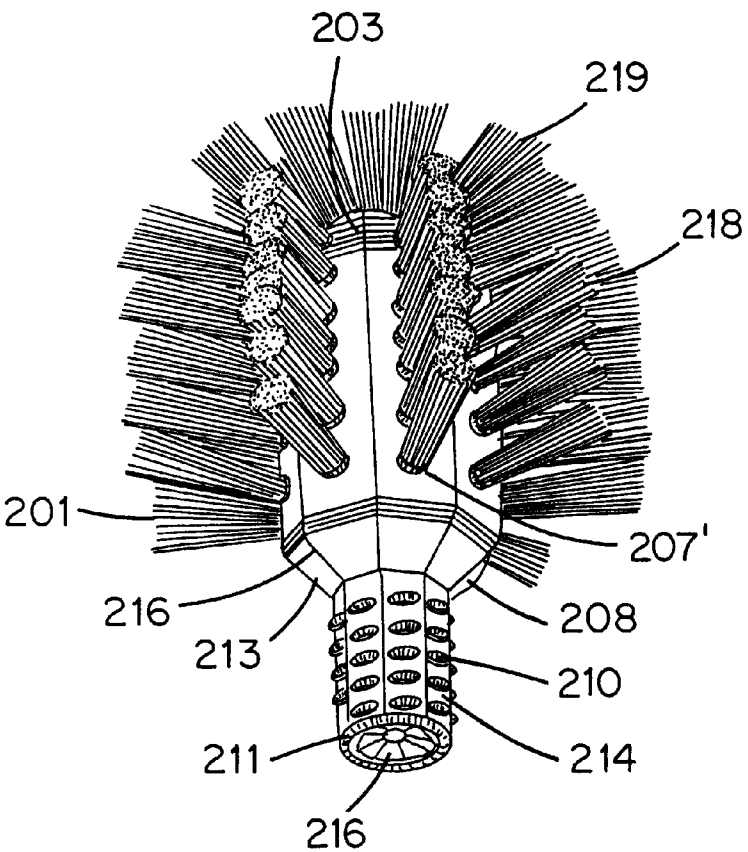
FIG. 9 is an assembled fused perspective end view of the brush construction using the support member of FIG. 5.

FIGS. 8 and 9 further illustrate a fused brush made in accordance with the instant invention. Filament tufts 218 radiate at a slight angle on the long parallel extensions 201 and are connected at 207'. The filament tufts 219 are disposed at different angles and are fused to the base extension 203. The angled surface 213 located on the extension 208 serves as a locking means against the surface of an attached handle, whereby the surface 213 acts as a stop when screwing the threaded portion 214 into any internally threaded hole in a handle (not shown).

Other important features include the conservation of raw materials, and the fact that the brushware made in accordance with this instant invention is totally recyclable. Hygienic properties also are imparted to this construction since there are no staple holes located on the brushware to attract or allow bacteria to collect, and by employing a non-absorbing thermoplastic polymer whereby no water or other chemical compounds can penetrate. The brushware article then is bacteria, mold and/or mildew resistant. The thin nature of the design allows the brushware item to dry completely after use, and brushware articles made in accordance with this invention also are dishwasher safe.

Many modifications and variations of the instant invention are possible in light of the above teachings. The device may be made from polypropylene molded resin and fused synthetic polypropylene monofilament as the preferred material, however, other synthetic resins such as polyesters, polystyrenes, polyamides and the like may be employed. Filament diameters and cross-sectional shapes may also be varied, with diameters ranging from 0.005 through 0.050 inches and cross-sectional shapes from circular, "X", "Y" and other shapes, thus imparting different cleaning attributes within the mat structure.

The molded base sectional members may have a circular shape as will as any polygonal shape so long as it is possible to configure a three dimensional space to accept a brush configuration. Either the upper or lower side of the molded surface may contain rib or structural fin-like projections in order to reinforce tufted surfaces for ultimate strength without sacrificing light-weight properties for the resultant brushware. Instantaneously picking and fusing of all the filament tufts in one plane and parallel filament arrangement prior to assembly into a three dimensional brushware device according to my patented process is used as part of the instant invention.

It will be readily seen by one of ordinary skill in the art that the present invention fulfills all of the objects set forth above. After reading the foregoing specification, one of ordinary skill will be able to effect various changes, substitutions or equivalents and various other aspects of the invention as broadly disclosed herein. It is therefore intended that the protection granted hereon be limited only by the definition contained in the appended claims and equivalents thereof.

I claim:

1. A pre-assembly base for a hollow tufted construction of thermoplastic material comprising:

a substantially flat member having a center portion and a plurality of mutually spaced, elongated, integral arms radiating outwardly therefrom, each arm consisting of segments extending along the longitudinal axis thereof from the center portion to the terminal portion thereof, adjacent segments being interconnected at ends thereof by flexible hinge portions;

a plurality of thickened, thermoplastic, tuft-receiving sites mutually spaced long a predetermined portion of an upper surface of each arm;

segmented thread means carried by the upper surface of the terminal portion of each arm and aligning means carried by the lower surface of each arm.

2. The base of claim 1 wherein each aligning means comprises a projection having sides disposed at an inwardly directed acute angle to the plane containing said terminal portion.

3. The base of claim 2 wherein each projection is a regular trapezoid in cross section.

4. The base of claim 1 wherein each terminal portion carries on its upper surface at least four mutually space thread segments.

5. The base of claim 4 wherein one portion of the arms carry five thread segments and another portion carries four.

6. The base of claim 1 wherein each arm comprises at least four segments.

7. The base of claim 6 wherein eight of said arms are provided.

8. Method of fabricating a hollow tufted construction comprising the steps of:

providing a base comprising- a substantially flat member having a center portion and a plurality of mutually spaced, elongated, integral arms radiating outwardly therefrom, each arm consisting of segments extending along the longitudinal axis thereof from the center portion to the terminal portion thereof, adjacent segments being interconnected at ends thereof by flexible hinge portions;

a plurality of thickened, thermoplastic, tuft-receiving sites mutually spaced long a predetermined portion of an upper surface of each arm;

segmented thread means carried by the upper surface of the terminal portion of each arm and aligning means carried by the lower surface of each arm;

fusing a tuft of the thermoplastic filaments at each of said sites to form a flat construction with integral tufts on the upper surface thereof; and assembling said hollow construction by gathering the terminal portions of said arms until said aligning means forms said ends into a circular cross sectional configuration.

9. The method of claim 8 wherein each aligning means includes a projection being a regular trapezoid in cross section and the steps of assembly includes abutting adjacent sides of adjacent projections.

10. The method of claim 8 wherein tuft receiving sites are located on the center portion of said base.

* * * * *